United States Patent [19]

Weissleder et al.

[11] Patent Number: 5,056,250

[45] Date of Patent: Oct. 15, 1991

[54] STACKABLE EASEL

[76] Inventors: Richard P. Weissleder, 71 Charter Cir., Ossining, N.Y. 10512; Lawrence I. Chipkin, N. Terry Hill Rd., Carmel, N.Y. 10512; Frank A. Lamendola, 9 Monroe Pl., Portchester, N.Y. 10573

[21] Appl. No.: 472,704

[22] Filed: Jan. 31, 1990

[51] Int. Cl.[5] ..... G09F 1/08

[52] U.S. Cl. ..... 40/539; 40/152.1; 248/465

[58] Field of Search ..... 40/539, 156, 107, 120, 40/152.1, 155, 152.2; 248/455, 465

[56] References Cited

U.S. PATENT DOCUMENTS

| | | | |
|---|---|---|---|
| 26,537 | 1/1859 | Pitz | 40/107 X |
| 553,963 | 2/1896 | Palmer | 40/120 X |
| 588,636 | 8/1897 | Engstrom | 40/152.1 X |
| 1,521,670 | 1/1925 | Bridges | 40/152.1 |
| 1,524,338 | 1/1925 | Chesney | 40/152.1 |
| 2,805,504 | 9/1957 | Stein | 40/152.1 X |

*Primary Examiner*—Kenneth J. Dorner
*Assistant Examiner*—J. Bonifanti
*Attorney, Agent, or Firm*—Lackenbach Siegel Marzullo & Aronson

[57] ABSTRACT

A self-standing placard adapted to bear a message on its front side. The placard comprises a curvable member fastened at one end to the back side of the placard at an acute angle, and a stiff, spacing member connected with reinforcement to the other end of the curvable member.

18 Claims, 1 Drawing Sheet

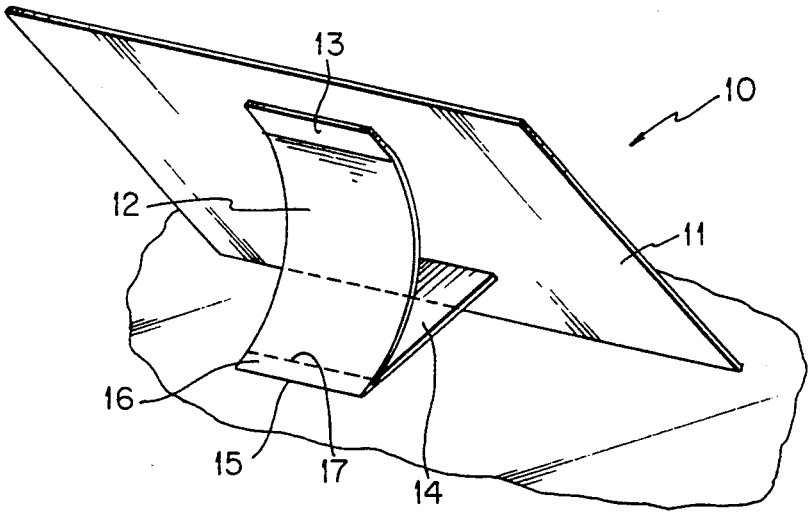
FIG. 1
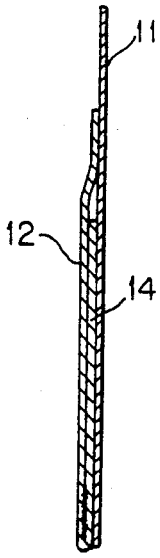
FIG. 2
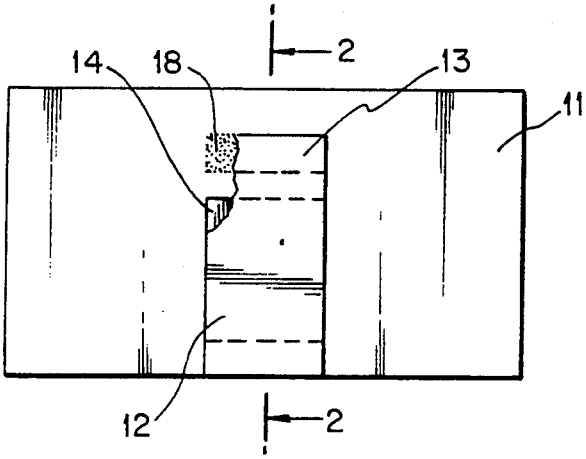
FIG. 3
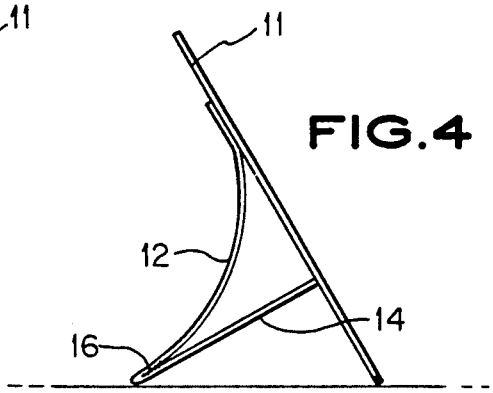
FIG. 4
FIG. 5
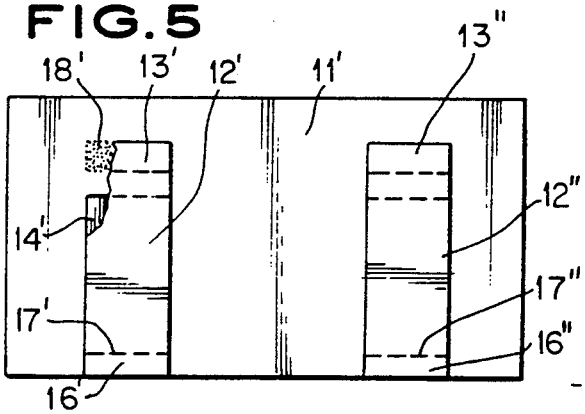
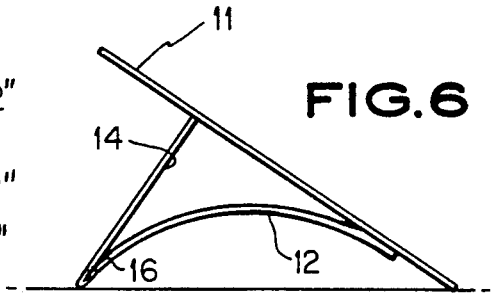
FIG. 6

STACKABLE EASEL

FIELD OF THE INVENTION

This invention relates to an easel for displaying messages, prices, or catching the reader's attention. Furthermore, this invention describes a simple, mechanical device for collapsing the easel when not in use or stacking a multitude of easels easily and compactly for storage or transport.

BACKGROUND OF THE INVENTION

U.S. Pat. No. 333,203 (1885) to Dick discloses an easel supported by an attached envelope.

U.S. Pat. No. 740,228 (1903) to Carpenter describes a message card adopted to fit on the handle of a door knob to be supported by the door.

U.S. Pat. No. 2,115,448 teaches an easel display support comprising two hinged flanges, means for maintaining an angle between the flanges, hinged struts for the flanges, and the flanges coated with a pressure sensitive adhesive.

U.S. Pat. No. 2,670,916 to Ranseen discloses a card supporting device having a back panel, retaining means for keeping it upright, a smaller front panel, means for securing the front panel to the back panel, and means for securing part of the front panel to the back panel while the unsecured part of the front panel provides gripping surfaces to grip and support a display card.

U.S. Pat. No. 2,919,512 to McDonald teaches an easel for holding cards or photographs comprising a holding body of transparent sheet material whose opposite edges are folded over to form slideway flanges, a prop insert having a joined prop tongue for sliding in the flanges, and the holder body constructed to receive the bottom of the prop insert.

U.S. Pat. No. 3,242,603 to Righenzi discloses a publicity card for display comprising a first sheet for receiving printing on its outer surface, flexible edges for the first sheet in order to form interned flaps, a second sheet hermetically sealed to the flaps of the first sheet to form a vented chamber as an air cushion between the sheets, an air vent in the second sheet, and hang-lip with a suspension hole in the edges of the second sheet overlaying the flaps.

U.S. Pat. No. 4,024,661 teaches a self-standing or telephone-mounted calendar comprising a sheet having a disc-shaped calendar, means for fixing the calendar to the central part of the dial of a telephone and a peripheral part positioned radially outward from the calendar, two cut lines nearly surrounding the calendar to separate it form the peripheral part, two connecting points to connect the peripheral part to the calendar part, the upper portion of the peripheral part being bendable backward to support the device, and an aperture to view the telephone number.

OBJECTS OF THE INVENTION

It is an object of this invention to provide a supported surface for easy reading of a message, a price, a name, or other information in a prominent fashion, easy-to-read, and differentiated from other papers lying horizontal on a desk, display case, or other surface.

It is a further object of this invention to provide a simple, inexpensive, easily-made support mechanism which can easily be collapsed for stacking a plurality of easels or shipment or storage.

Yet a further object is to provide a surface for a message essentially immune to dirt, spills, stains, or misplacement, due to an angular position.

Another object is to provide a message surface set off from the normal accoutrements from a desk around it.

Still a further object is to provide a flat surface for writing a message, in fact flat enough to be put into a standard typewriter and typed upon.

Yet another object is to provide a supporting mechanism for a placard which can be easily changed from flat to supported position or supported to flat position quickly and simply.

Other objects of the invention will be apparent to those skilled in the art.

SUMMARY OF THE INVENTION

Surprisingly, the proceeding objects are realized by a simple, novel construction comprising:

a) a placard for bearing a message on its front side;
b) a curvable member fastened at one end to the back side of the placard at an acute angle; and
c) a stiff, spacing member connected with reinforcement to the other end of the curvable member in the direction toward the back of the placard, whereby when the spacing member forms an angle between about 60 degrees and about 120 degrees with the back of the placard, the connected spacing and curvable members support the placard, and when the spacing member is collapsed at an angle less than about 15 degrees to the back of the placard, a plurality of the self-standable placard can be easily stacked.

It is preferred but not necessary that the acute-angle interface be reinforced with glue, polyvinyl acetate latex, or other suitable adhesive or penetrant at the interior interface of the curvable member and spacing member.

Normally the curvable member is about one-fourth the width of the placard and the spacing member is the same width as the curvable member, but the stackable easel may be constructed with the curvable member and spacing member the same width as the placard. In fact, the placard, the curvable member, and the spacing member can be constructed from one continuous piece of paper, cardboard, plastic sheet, parchment, stationary stock, animal skin or membrane, cellulosic sheet, bark, synthetically modified cellulosic sheet, proteinaceous sheet, or any other self-standing sheet capable of holding ink or graphite or mixtures thereof. Preferably this message-bearing stock is from about 0.05 to about 5mm thick, more preferably from about 0.1 to 0.5 mm thick, most preferably about 0.2 mm thick, that is the thickness of a typical index card, business card, or price card in a store. No matter what the material of construction, it is preferable to reinforce the interior of the junction of the curvable and spacing member with an adhesive or penetrant to stiffen that junction. The three members may all be constructed from the same material, three different materials, or any combination of materials.

In addition to comparable small office, business, or personal use there may be advertising applications for the present invention for which the size may be increased by one or two orders of magnitude.

Advertising or other specialty applications may involved large (one or more meters) stackable easels with components up to one or two centimeters thick, as long as the components can be curvable.

Specialty shapes include hats, hamburgers, champagne glass, coffee cup, ice cream cone, shoes automobiles, airplane, bus, book, money bill, or any other shape.

Stackable easels may be of any color. The placards and the spacing member may be of any material of construction. It is the curvable member which must be a) curvable or flexible and b) fastenable to the placard and the spacing member. For large constructions this could be aluminum, steel, stainless steel, wood, plastic, or any other suitable material of construction.

There may be a plurality of more narrow collapsible curvable/spacing member combinations, one wide one, or any number of such collapsible easels of the same or different widths. The spacing member may be the same size, wider, or more narrow than the curvable member.

Preferably the curvable member or members is/are fastened about one-fourth the way down form the top side of the placard, but the curvable member may be hinged at the top of the placard or placed below the center of the placard. The relative size of the placard, curvable member and spacing member, of course, control angle at which the easel stands when in the supported position. It is particularly favored that the curvable member form an angle from about 60 degrees to about 120 degrees with the placard and the spacing member form a 90 degree angle with the placard in the support position. In the collapsed position the spacing member and the curvable member will form an angle less than 15 degrees with the back of the placard. For any relative ratio of the curvable and spacing member there is a high tilt and low-tilt position depending on whether the placard is placed with the curvable of spacing member up.

It is preferred that the stackable easel of the present invention be constructed of stiff, commercial, filled, glossy paper about 0.2mm thick. Such stationery stock is conventional "index card" stock filled with titania, calcium carbonate, silica, barium sulfate, or other conventional, commercial filler. A particular favored size placard is about 7.5 by 12.5 cm, the fastening point of the curvable member is about 1.5cm from the top of the 12.5cm side, the curvable member is about 10cm long and about 4cm wide, and the internal "glue-line" at the junction of the curvable member and spacing member about 1cm wide, and the spacing member is about 4cm long. Any size stackable easel maintaining the same ratios of sizes as immediately preceding is particularly preferred, but a wide range of ratios and dimensions of the three members is useful. A thin stackable easel, capable of being inserted in a standard typewriter carriage is particularly preferred.

In addition to being employable in a standard typewriter, a suitably thin stackable easel may also be employed in conjunction with a mechanical printer, word processing apparatus, computer, facsimile apparatus, computer printer or the like.

BRIEF DESCRIPTION OF THE FIGURES

FIG. 1 is a rear perspective view of an embodiment of the present invention in its high-tilt, supported, easel position.

FIG. 2 is a side view of an embodiment in the collapsed position.

FIG. 3 is a top view of the back of a one-support embodiment of the invention with a broken-out section of the reinforced joint of the curvable and spacing members.

FIG. 4 is a side view of a stackable easel in a highly-tilted supported position.

FIG. 5 is a top view of the back of a two-support embodiment of the invention with a section of the left hand reinforced join of the curvable and spacing member broken out to show the reinforcing adhesive or penetrant.

FIG. 6 is a side view of low-tilt supporting position for a stackable easel.

A DETAILED DESCRIPTION OF SOME PREFERRED EMBODIMENTS

Without limiting the scope of the present invention as disclosed in the Summary Of The Invention above or the claims below, the Figures illustrate some of the preferred embodiments of the present invention.

FIG. 1 shows a stackable easel 10 in the supported, high-tilt position of placard 11. Curvable member 12 is fastened to placard 11 at junction 13. The fastening may be by adhesive, rivet, or any other conventional fastening means. Spacing member or bracing portion 14 is connected to the other end of curvable member 12 at junction 15, which preferably has a reinforcing adhesive or stiffening penetrant in area 16, ending at glue-line 17. The adhesive or penetrant may be an animal glue, a polyvinyl acetate-type adhesive, a formaldehyde melamine adhesive/stiffening penetrant for the preferred filled, glossy cellulosic stationary product, or any other of the materials of construction for the present invention. The placard 11, the curvable member 12, and the spacing member 14 an be made of the same or different materials of construction.

FIG. 2 shows placard 11, curvable member 12, and spacing member 14 in the collapsed, stackable position. It is also a cross-section at the line 2—2 of FIG. 3.

FIG. 3 shows a back top view of placard 11, showing also curvable member 12, fastening junction 13, broken away to show adhesive 18, and a portion of spacing member 14.

FIG. 4 shows a side view of placard 11, curvable member 12, and spacing member 14, with stiffening area 16 in a high-tilt position.

FIG. 6 shows a side view of placard 11, curvable member 12, spacing member 14, and stiffening junction area 16 in a low-tilt position.

FIG. 5 shows another embodiment of the present invention having dual supports in a top view of the back. Placard 11' is fastened to curvable members 12' and 12" at junction 13' and 13". Fastening junction 13' is broken away to show adhesive 18' and part of spacing member 14'. Glue-line 17' and 17" are also shown for adhesive/penetrant stiffening areas 16' and 16".

It must be emphasized that FIGS. 1–6 merely illustrate some preferred embodiments of the present invention, which may have a wide variety of sizes, ratios of dimension, number-size-width-length of curvable and spacing members, a broad variety of materials of construction fastening together by any conventional fastening means, and stiffened or reinforced at the junctions of the curvable and spacing members by any of a wide variety of conventional stiffening, penetrant, or reinforcing means such as organic-based glues, latex-based polymers, or reinforcing resins.

While the invention is disclosed with the presently preferred embodiments, it is not intended that the invention be limited to the described embodiment. It will be obvious to those skilled in the art that modifications may be made without departing from the scope and spirit of the invention. Thus, it is intended that appended claims cover all equivalent variations as may be subsequently contemplated.

Protection of the broad scope of the disclosure of the present invention is sought by Letters Patent encompassed by the claims below:

We claim:

1. A collapsible self-standing device having operative and inoperative positions comprising:

a placard member for bearing a message and having an easel for supporting said placard on a substrate; and said easel further comprising a first member extending at one end from the placard member and adapted to be retained in a curved configuration when placed in the operative position, and having a single spacing member at the other end of the first member and having a free end in contact with said placard member when said device is in the operative position, further having a fold line between said first member and said spacing member, and additional means in juxtaposition to said fold line further securing said first and spacing members together, whereby said easel when collapsed repositions said first member and said spacing member in an overlapped inoperative position.

2. A device as in claim 1 wherein said fold line separates the first member and the spacing member.

3. A device as in claim 1, wherein the width of the first member and the width of the spacing member is about one-fourth the width of the placard member.

4. A device as in claim 1, wherein the width of the first member and the width of the spacing member is about the width of the placard member.

5. A device as in claim 1, wherein thee is a plurality of first members and spacing members each connected to one another and fastened to the placard member.

6. A device as in claim 1, wherein the first member, and the spacing member are of the same width and are made from a single piece of material and said additional means comprises an adhesive at said fold line.

7. A self-standing device as in claim 6, wherein said placard member is also made from said single piece of material.

8. A device as in claim 1, wherein the three members are fashioned from materials between 0.05 and 5mm thick.

9. A device as in claim 1, wherein the three members are about 0.2mm thick.

10. A device as in claim 1, wherein materials for construction of the members are selected from the group consisting of paper, stationery stock, thin cardboard, plastic materials, animal skins and membranes including parchment, cellulosic sheets including bark synthetically modified cellulosics or proteinaceous material, flat sheetings adapted to hold ink or graphite, and mixtures thereof.

11. A device as in claim 10, wherein the placard member is thin enough for insertions in a standard typewriter for typing messages thereon.

12. A self-standing device comprising:

a placard member for bearing a message on its front side;

a first member extending at one end from the placard member and adapted to be curved, and a spacing member at the other end of the first member, having a free end in contact with said placard member when said device is in the operative position, further having a fold line between said first member and said spacing member, and additional means in juxtaposition to said fold line further securing said first and spacing members together, whereby when erected the spacing member forms an angle between about 60 degrees to about 100 degrees with the back of the placard, so that the first member and the spacing member support the placard member, and when the spacing member is collapsed and flush against said first member, a plurality of the self-standable placards can be stacked one atop another in a packet.

13. A self-standing device, comprising:

a placard member adapted for bearing a message, and having front and back sides; and a support mechanism having an open and a closed position and comprising a flexible portion having a first end, and a second end opposite the first end extending from the placard member, and a bracing portion connected at the first end of said flexible portion and having a free end, including additional means further securing said flexible and bracing portions together, said bracing portion being positioned substantially flat against the flexible portion and placard member when said support mechanism is in a closed position, and being positioned substantially perpendicular to said placard member when in said open position so that said bracing portion urges in a curved arching manner said flexible portion to arch in a curved manner and positions the first end of said flexible portion away from the back side of the placard member with the free end of said bracing portion being in contact with the back side of the placard member for supporting the placard member in a generally upright angular manner when said placard is placed on a substrate.

14. A self-standing device as in claim 13, wherein the bracing portion is positioned between the flexible portion and the substrate when the support mechanism is in the open position so that a generally high tilt relative to said substrate is obtained for the self-standing placard.

15. A self-standing device as in claim 13, wherein the flexible portion is positioned between the bracing portion and the substrate when the support mechanism is in the open position so that a generally low tilt relative to said substrate is obtained for the self-standing placard.

16. A self-standing device as in claim 13, wherein the flexible portion and the bracing portion are separated by a fold line and are further connected together with an adhesive in juxtaposition with said fold line.

17. A self-standing device as in claim 13, wherein there is a plurality of support mechanisms with each being fastened to the placard member.

18. A self-standing device as in claim 16, wherein the placard member, flexible portion and bracing portion are made from one continuous piece of material.

* * * * *

UNITED STATES PATENT AND TRADEMARK OFFICE

CERTIFICATE OF CORRECTION

PATENT NO. : 5,056,250

DATED : 10-15-91

INVENTOR(S) : Richard P. Weissleder and Lawrence I. Chipkin and Frank A. Lamendola It is certified that error appears in the above—identified patent and that said Letters Patent is hereby corrected as shown below:

On the title page, item [76]:

Change the zip code of Richard P. Weissleder to read -- 10562 --.

Signed and Sealed this

Twenty-third Day of February, 1993

*Attest:*

STEPHEN G. KUNIN

*Attesting Officer*

*Acting Commissioner of Patents and Trademarks*